US006216587B1

(12) United States Patent
Foley

(10) Patent No.: US 6,216,587 B1
(45) Date of Patent: Apr. 17, 2001

(54) GOLF BALL MARKING DEVICE

(76) Inventor: Keith Foley, 4440 PGA Blvd., 402, Palm Beach Gardens, FL (US) 33410

( * ) Notice: Subject to any disclaimer, the term of this patent is extended or adjusted under 35 U.S.C. 154(b) by 0 days.

(21) Appl. No.: 09/307,617

(22) Filed: May 7, 1999

(51) Int. Cl.[7] ..... B41F 17/30
(52) U.S. Cl. ..... 101/35; 101/DIG. 40
(58) Field of Search ..... 101/DIG. 40, 38.1, 101/35, 36; 473/406

(56) References Cited

U.S. PATENT DOCUMENTS

| | | | | |
|---|---|---|---|---|
| 1,814,170 | * | 7/1931 | Long | 101/35 |
| 4,441,715 | | 4/1984 | Chen . | |
| 4,974,511 | * | 12/1990 | Hsi-Chou | 101/38.1 |
| 5,564,707 | | 10/1996 | Dinh . | |
| 5,878,659 | * | 3/1999 | Hatter | 101/35 |
| 5,925,186 | * | 7/1999 | Klimek | 118/500 |
| 6,004,223 | * | 12/1999 | Newcomb | 473/257 |

FOREIGN PATENT DOCUMENTS 298 08 618 U 8/1998 (DE) .
217 435 7/1924 (GB) .

* cited by examiner

*Primary Examiner*—John S. Hilten
*Assistant Examiner*—Kevin D. Williams
(74) *Attorney, Agent, or Firm*—McHale & Slavin

(57) ABSTRACT

A golf ball marking assistance device includes a template member sized and shaped to positively engage a golf ball to be marked. The template member includes a main body that forms a resiliently-deformable retention cavity that frictionally secures a golf ball inserted therein. Articulation handles extending from opposite ends of the main body allow the template to be moved between a securing orientation and a release orientation. A marking slot extending through the main body allows use of a marking device to place diagnostic indicia, such as a stripe or stripes, onto the exterior of a golf ball secured within the retention cavity. The device may include indicia-protecting recesses that prevent unwanted contact between newly-marked indicia and the interior of the retention cavity. An attachment aperture allows connection of the device to a golf bag via a tethering member, and the device may include a marking device holder to removably secure a marking device when not in use.

14 Claims, 3 Drawing Sheets

GOLF BALL MARKING DEVICE

FIELD OF THE INVENTION

This invention is directed to golf training aids and, in particular to a device that facilitates the marking of diagnostic indicia on the exterior of a golf ball.

BACKGROUND OF THE INVENTION

Golf is a game of skill in which a set of specialized clubs is used to strike a golf ball, thereby guiding the ball around a golf course. A golf course is divided into segments, called "holes," and score is kept regarding the number of club strokes required to complete each hole. A chief goal of golf is the completion of a given course using the fewest number of strokes possible.

A variety of golf equipment has been designed to improve player performance. For example, golf clubs with different lengths, weights, and club head sizes have been developed to suit the swing and stance preferences of various players. Many golfers use specialized shoes to help maintain proper footing. Some golfers even wear clothing made from fibers engineered to wick away moisture, thereby keeping the player dry and cool.

However, while golf performance does depend upon the use of proper equipment, a player's choice of equipment is not the only factor that affects play. Players must also develop a critical set of skills to succeed at golf. One of the most important skills a golfer can develop is the ability to hit a golf ball with consistency. Once a player's game becomes consistent, the player may then isolate specific areas of performance which need improvement. Many devices exist to help a golfer improve consistency.

U.S. Pat. No. 4,441,716 discloses a diagnostic device that asists a golfer improve consistency by helping the golfer monitor golf club orientation. More specifically, the '716 device helps a golfer identify the exact three-dimensional orientation of a golf club face at the moment the ball is struck. The '716 device includes a calibrated grid provided on a golf ball and a marking surface disposed on golf club face. Striking the ball with the marking-surface-equipped club face will impart a mark on the ball within a specific location on the calibrated grid. The golfer may then correlate the marked spot with the flight of the ball. The '716 device also discloses a reader that helps an individual determine the true location of the imparted mark; an included chart provides analysis of the mark location. The '716 also includes an alignment scope to help orient the grid when the ball is placed on a tee. Although the '716 device may help some golfers, the wide array of components makes the '716 subject to user error and a degradation of accuracy produced by wear and tear over time.

U.S. Pat. No. 4,974,511 is a portable device that uses centrifugal forces to identify the centerplane of a golf ball. The '511 patent helps a golfer improve consistency by allowing a golfer to account for variations that occur from golf ball to golf ball. The '511 device includes a cylindrical housing and motor-driven a motor-driven rotor dish. The rotor dish extends upward from a stabilizing dish mounted at the top of the device housing. During use, a golf ball is placed onto the rotor dish and a rigid cover is frictionally attached to the stabilizing dish. The included motor is activated, thereby spinning the rotor dish and the golf ball resting thereupon. As the rotor dish continues to spin, centrifugal forces acting on the ball cause the ball to assume a centerplane-identifying orientation. The centerplane location may be marked by a pencil or pen inserted through a slot in the rigid cover. Once the centerplane is marked, the motor is deactivated and the ball is removed. Although the '511 device may help identify the centerplane of a selected ball, the '511 may be difficult to use in some instances. The '511 device requires relative shifting between the ball and the remainder of the device. That is, the '511 device does not positively engage a ball to be marked. As a result, the '511 device may be difficult to use if power is not available to operate the spinning motor. Additionally, the '511 device may not be suitable for use with hollow "training" balls, the light weight of which will not produce sufficient friction between ball and rotor dish for proper operation.

Although known ball marking devices may help some golfers become more consistent, these devices are unsuitable in many situations. Thus, what is needed is a golf ball marking device that includes advantages of the known devices, while addressing the shortcomings they exhibit. The device should allow marking of a golf ball with diagnostic indicia, including a stripe or stripes, aligned with a great circle of the ball. The device should be securely attachable to, yet easily removed from, a selected golf ball. The device should positively engage golf balls of different diameters. The device should include provisions to automatically maintain a golf ball in a preferred orientation within the device. The device should also be lightweight and easily attached to a golf bag for remote use or to an anchoring member for security.

SUMMARY OF THE INVENTION

The present invention is a golf ball marking device that helps individuals mark diagnostic indicia on the surface of golf balls. The device includes a template member sized and shaped to positively engage a golf ball to be marked. The template member is characterized by a curved main body having articulation handles extending from opposite ends thereof. The template main body resembles an arched channel and forms a retention cavity into which a golf ball may be securely inserted.

The template main body is characterized by a marking slot extending therethrough. The marking slot is centered between the side edges of the template main body and is oriented parallel thereto.

Centering ridges located on the side edges of the template main body maintain a golf ball inserted into the retention cavity in a preferred orientation. The centering ridges ensure that a great circle of the golf ball engaged by the template will remain aligned with the marking slot while the ball is secured within the retention cavity.

In addition to having articulation handles extending therefrom, the opposite ends of the main body each include an indicia-protection recess disposed within a retention cavity-facing surface thereof. Each recess is an area of reduced thickness that reduces the likelihood of contact between the main body ends and newly-marked diagnostic indicia during removal of the ball from the retention cavity. The recesses are especially useful when the diagnostic indicia is made with a pencil or ink that easily smudges.

During use, a golf ball is inserted into the retention cavity, and the template resiliently deforms to positively engage the ball. A marking device is used in cooperation with the marking slot to place diagnostic indicia, such as a stripe or stripes, on the surface of the engaged golf ball. Once the ball has been marked, the ball is removed by grasping the articulation handles and drawing the handles apart. As the handles are drawn apart, the retention cavity is again resiliently deformed, and the ball is released from the retention cavity. The indicia-protection recesses endure that the indicia is not disturbed as the ball leaves the retention cavity.

The device also includes an attachment aperture disposed within the template main body. The attachment aperture allows use of a tethering member, such as a ring or strap, to connect the device with a golf bag for use of the device in a remote location. The attachment member may also be used to link the device to an anchoring location.

A marking device holder extends from the template main body, thereby providing a convenient storage location for the marking device used to produce the diagnostic indicia. If necessary for the marking device chosen, the holder may act as a sealing cap to prevent the marking device from drying out or making unwanted stray marks.

Thus, it is an objective of the instant invention to provide a golf ball marking device that facilitates marking of a golf ball with diagnostic indicia, including a stripe or stripes, aligned with a great circle of the ball.

Yet another objective of the present invention is to provide a golf ball marking device that is securely attached to, yet easily removed from, a golf ball selected for marking.

A further objective of the present invention is to provide a golf ball marking device that positively engages golf balls of different diameters, thereby allowing use with a variety of balls.

Yet another objective of the present invention is to provide a golf ball marking device that includes provisions to guide and maintain a golf ball in a preferred orientation within the device.

An additional objective of the present invention is to provide a golf ball marking device that is lightweight and easily attached to a golf bag for remote use or to an anchoring member for securement.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 2:
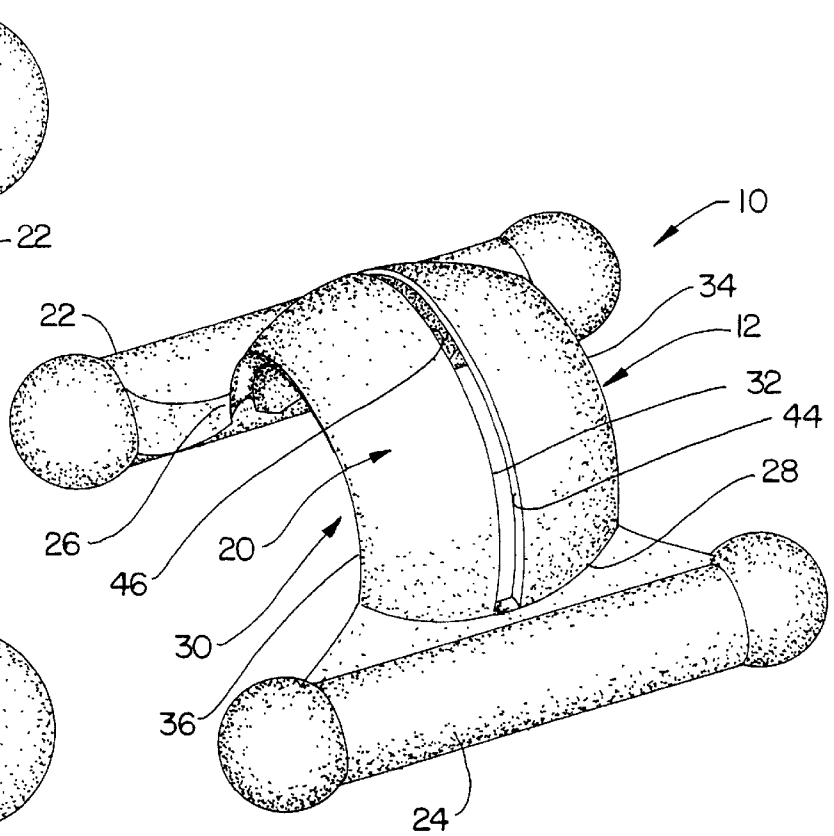
FIG. 2 is a rear perspective view of the golf ball marking assistance device shown in FIG. 1.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Figure 1:
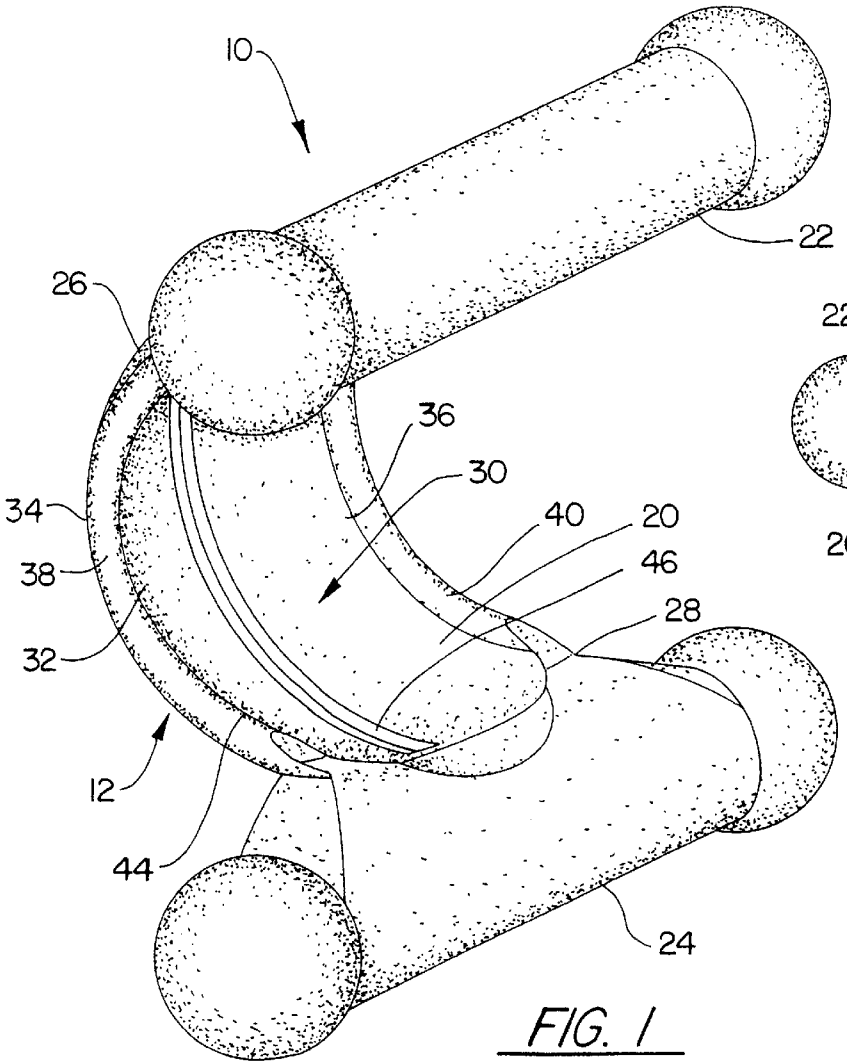
FIG. 1 is a front perspective view of the golf ball marking assistance device of the present invention.
Figure 4:
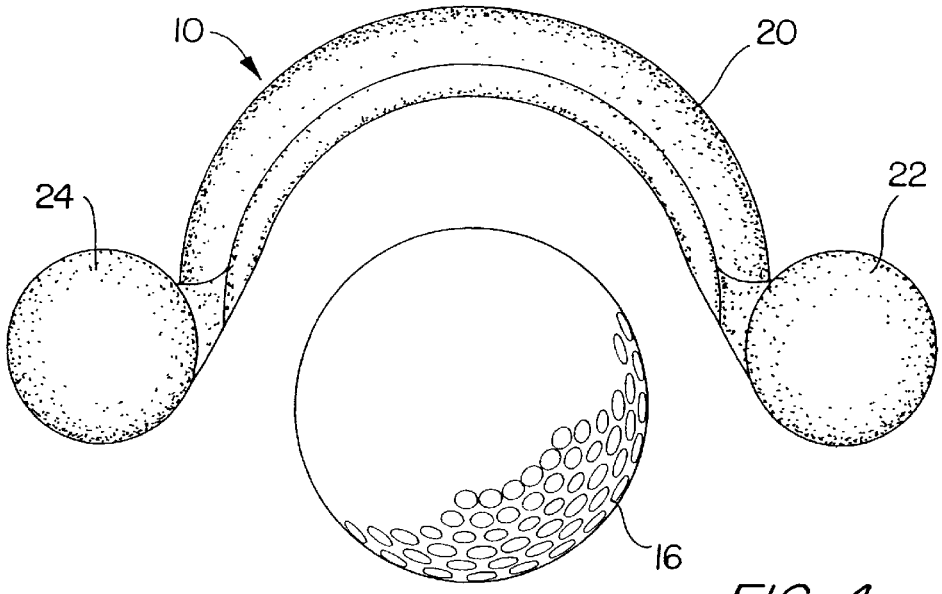
FIG. 4 is a side elevation view of the golf ball marking assistance device of the present invention in a ball-releasing orientation.
Figure 5:
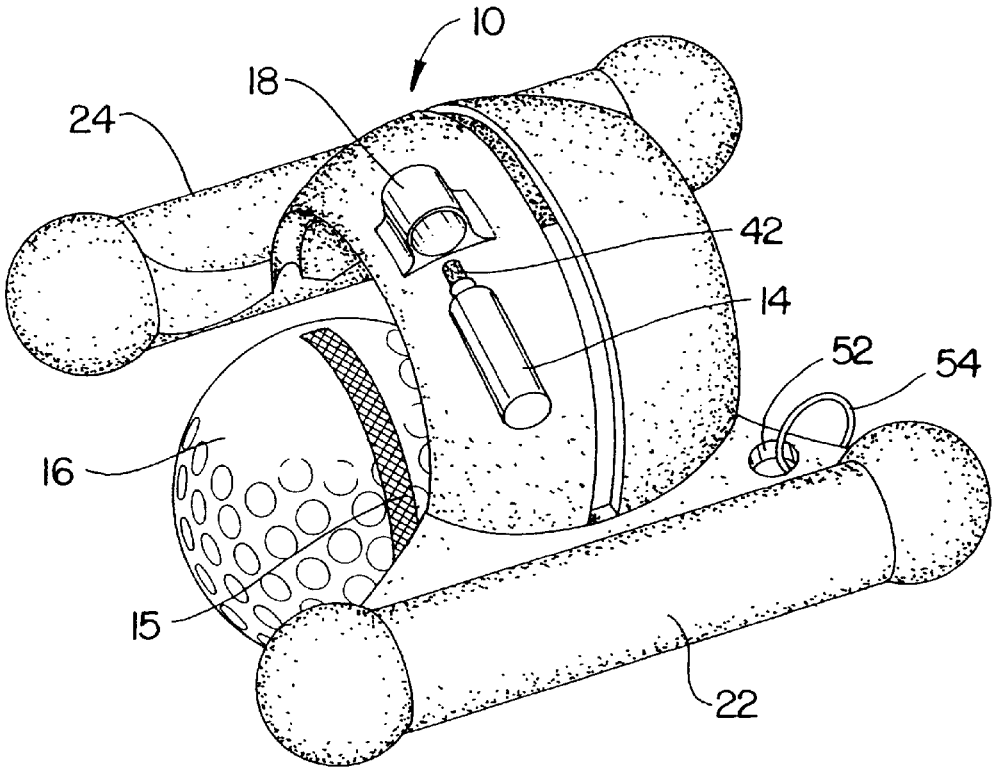
FIG. 5 is a perspective view of the golf ball marking assistance device of the present invention including an attachment aperture and a marking device holder.

Now with reference to FIGS. 1, 4 and 5, the ball marking assistance device 10 of the present invention is shown. By way of overview, the device 10 includes a template member 12 that cooperates with a marking device 14 to facilitate selective placement of diagnostic indicia 15 on a golf ball 16. The device 10 may also include a marking device holder 18 that allows convenient storage of the marking device 14 when not in use. The device 10 will now be described in detail.

With continued reference to FIG. 1, the template member 12 includes an arc-shaped main body 20 sized and shaped to partially surround a regulation golf ball 16. In a preferred embodiment, the main body 20 resembles a trough-like channel and includes articulation handles 22,24 extending from opposite ends 26,28 thereof. As will be described further below, the main body 20 forms a retention cavity 30 that will selectively engage a golf ball 16 inserted therein, holding the ball securely until removal is desired.

As seen with additional reference to FIG. 2, a marking slot 32 extends through the main body 20. With additional reference to FIG. 2, the marking slot 32 extends between the first and second ends 26,28 of the template main body 20 and is preferably centered between the first and second side edges 34,36 thereof.

Figure 3:
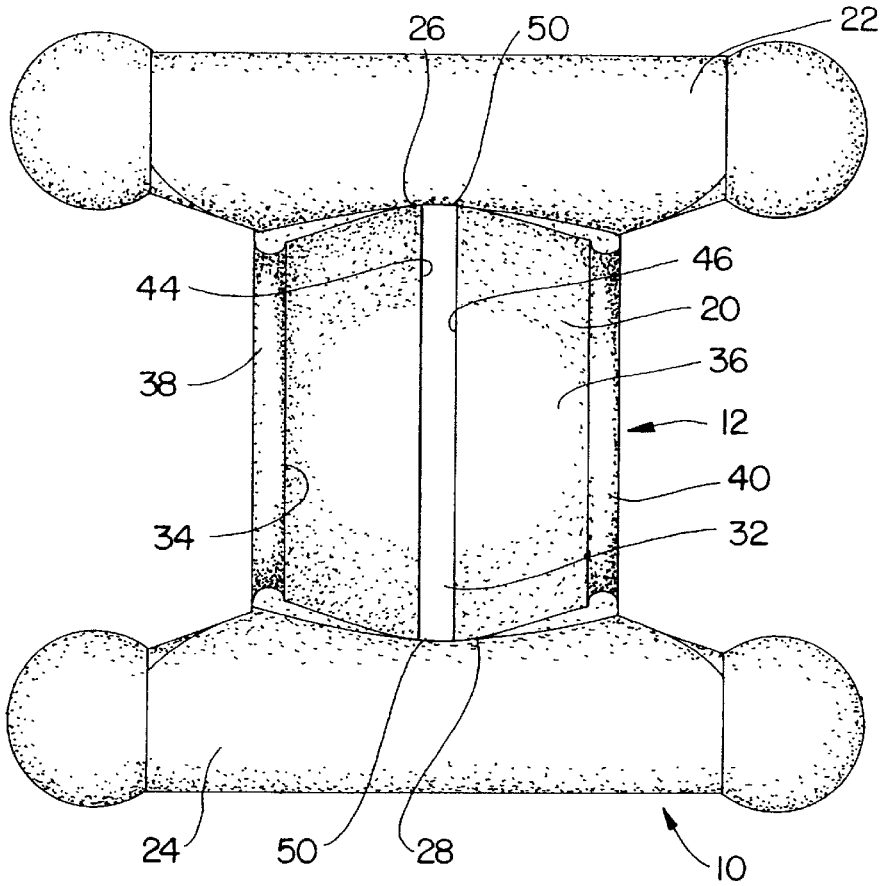
FIG. 3 is a bottom plan view of the golf ball marking assistance device shown in FIG. 1.

With additional reference to FIG. 3, the template member 12 also includes centering members 38,40 that ensure proper positioning of a golf ball 16 inserted into the retention cavity 30. In a preferred embodiment, each centering member 38,40 is a solid ridge that extends along a corresponding side edge 34,36 of the template main body 20. As seen in FIGS. 1 and 3, the centering members 38,40 are parallel to the marking slot 32. The centering members 38,40 extend into the retention cavity 30 slightly and cooperatively center a golf ball 16 therein. In this manner, the marking slot 32 is securely aligned with a great circle of the golf ball 16 placed in the retention cavity 30.

In preparation for marking a golf ball 16 with diagnostic indicia 15, the ball is pressed into the retention cavity 30, where it encounters the centering members 38,40. As the ball 16 is forced into the retention cavity 30, the ball momentarily increases the distance between the articulation handles 22,24 and causes the first and second ends 26,28 of the main body 20 to temporarily flex apart. As the ball 16 comes to rest within the retention cavity 30, the template main body 20 returns to its original shape, locking the ball in place. As this occurs, the articulation handles 22,24 return to their original relative spacing. At this point, the ball 16 is ready to be marked.

In keeping with the objectives of the present invention, the template main body is preferably made of a flexible plastic, such as polypropylene, acetyl, nylon, or other similar resiliently-deformable material. However, the template member need not be constructed from resiliently-deformable material. It is noted that the template may be hinged, thereby allowing use of non-deformable materials and the formation of a retention cavity 30 that surrounds substantially all of a golf ball 16.

As noted above, once a ball 16 is locked within the retention cavity 30, the ball is prepared for labeling with diagnostic indicia 15. In a preferred embodiment, the diagnostic indicia 15 is applied by inserting a marking device 14 into the marking slot 32 and forming a stripe, or stripes, on the surface of the ball 16. More particularly, the marking device 14 is preferably a felt-tipped pin having a marking nub 42 sized and shaped to travel freely within the marking slot 32. The marking slot 32 is chamfered to ensure that the marking nub 42 will contact the exterior of the ball 16 without interference from the marking slot side walls 44,46. This arrangement allows use of marking devices 14 with relatively short nubs 42 and tall nubs, alike. Additionally, when a thick-nubbed marking device 14 is used, a single broad stripe may be drawn within the marking slot 32. Alternately, use of a thin-nubbed marking device 14 allows dual lines to be drawn, using the slot side walls 44,46 as a guide for each line.

Although the marking device 14 has been described as a felt-tipped pen, other marking devices may also suffice. For example, the marking device may be a lead or grease pencil. Chalk, pastels, and crayon sticks may also be used if narrow enough to extend through the marking slot 32 to contact the surface of the ball 16 secured within the retention cavity 30. It is noted that the use of non-permanent marking devices 14 allows transfer of indicia to a golf club face for post-swing examination.

When not in use, the marking device 14 may be conveniently secured within the included marking device holder 18, as shown in FIG. 5. In a preferred embodiment, the marking device holder 18 extends from the template main body 20, opposite the retention cavity 30, and the marking device holder 18 provides a cap for the marking device 14. Alternatively, if a cap is not needed for the chosen marking device 14, the marking device holder 18 may be a simple friction clip.

Once the diagnostic indicia 15 has been marked on the ball 16, the ball is ready for removal from the template 12. To remove a ball 16 from the template 12, an individual grasps the articulation handles 22,24 and pulls the handles away from each other, thereby increasing the distance between the main body first and second ends 26,28. As the handles 22,24 are pulled apart, the retention cavity 30 resiliently deforms, and the ball 16 drops out of the retention cavity 30, exiting between the spaced-apart main body ends 26,28, as shown in FIG. 4. Once the ball 16 is out of the retention cavity 30, the articulation handles 22,24 are released and the template 12 returns to its original shape.

In further keeping with the objectives of the present invention, the main body 20 first and second ends 26,28 each includes a region of reduced thickness 48,50. These tapered regions 48,50 ensure that indicia 15 placed on the ball 16 is not rubbed off or smudged as the ball 16 is removed from the template 12.

To increase the utility of the device 10, the template member 12 also includes an attachment aperture 52, shown in FIG. 5. The attachment aperture 52 allows the device 10 to be attached to a golf bag, not shown, or other anchoring location via a tethering member 54. A rigid hoop 54 is a preferred tethering member; however, a flexible strap or cable would also suffice.

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

What is claimed is:

1. A ball marking assistance device comprising:

a template member having an elongated resiliently-deformable curved main body, a channel shaped arched retention cavity formed in said main body, said main body being sized to frictionally engage a ball inserted therein; and a marking slot extending through said main body;

whereby said device will partially surround and frictionally engage a ball inserted within said retention cavity and whereby said marking slot accommodates a marking device to draw diagnostic indicia on an exterior surface of said ball.

2. The ball marking assistance device of claim 1 further including:

at least one articulation handle disposed on said template member to move said main body between a securing orientation and a release orientation.

3. The ball marking assistance device of claim 1 further including:

alignment means disposed on said main body for centering a ball with respect to said marking slot;

whereby said alignment means ensures said marking slot is aligned with a great circle of said ball.

4. The ball marking assistance device of claim 3 wherein said alignment means includes at least one positioning ridge disposed on said main body.

5. The ball marking assistance device of claim 1 further including at least one indicia-protecting recess disposed within said main body.

6. The ball marking assistance device of claim 1 further including a marking device holder disposed on an exterior surface thereof.

7. The ball marking assistance device of claim 1 further including at least one attachment aperture for securement of a tethering member thereto.

8. A ball marking device comprising:

a template member having a resiliently-deformable main body shaped in an elongated arched, channel shape to form an adjustably-sized retention cavity, said retention cavity being sized to frictionally engage a ball inserted therein; a marking slot extending through said main body;

articulation means disposed on said template member for moving said main body between a securing orientation and a release orientation; and centering members disposed on said main body near each longitudinal edge for centering a ball with respect to said main body;

whereby said device will partially surround and frictionally engage a ball inserted within said retention cavity, and said slot is aligned with a great circle of said ball.

9. The ball marking assistance device of claim 8 further including at least one indicia-protecting recess disposed within said main body.

10. The ball marking assistance device of claim 8 further including at least one attachment aperture for securement of a tethering member thereto.

11. A ball marking assistance device for placing a diagnostic mark on a ball comprising:

a curved template member having a resiliently-deformable one-piece main body shaped to form an adjustably-sized retention cavity, said retention cavity being sized to frictionally engage a ball inserted therein; a marking slot extending through said main body;

at least one articulation handle disposed on said template member to move said main body between a securing orientation and a release orientation; and alignment means disposed on said main body for centering a ball with respect to said marking slot;

whereby said device will partially surround and frictionally engage a ball inserted within said retention cavity and said marking slot is adapted to define diagnostic indicia on an exterior surface of said ball, and said alignment means ensures said marking slot is aligned with a great circle of said ball.

12. The ball marking assistance device of claim 11 further including at least one indicia-protecting recess disposed within said main body.

13. The ball marking assistance device of claim 12 further including a marking device holder disposed on an exterior surface thereof.

14. The ball marking assistance device of claim 13 further including at least one attachment aperture for securement of a tethering member thereto.

* * * * *